United States Patent [19]

Takahashi

[11] Patent Number: 4,873,423

[45] Date of Patent: Oct. 10, 1989

[54] HIGH TEMPERATURE HEATING FURNACE

[75] Inventor: Susumu Takahashi, Yokohama, Japan

[73] Assignee: Kanto Yakin Kogyo Kabushiki Kaisha, Japan

[21] Appl. No.: 184,224

[22] Filed: Apr. 21, 1988

[30] Foreign Application Priority Data

Aug. 21, 1987 [JP] Japan ..... 62-207912

[51] Int. Cl.[4] ..... H05B 3/62

[52] U.S. Cl. ..... 219/390; 219/553

[58] Field of Search ..... 219/390, 405, 411, 552, 219/553; 373/137, 113; 501/99

[56] References Cited

U.S. PATENT DOCUMENTS 1,807,147 5/1931 Brooke ..... 373/113
4,147,888 4/1979 Sato ..... 219/552
4,153,449 5/1979 Greenwald ..... 420/583
4,159,415 6/1979 Williams ..... 219/390

*Primary Examiner*—Teresa J. Walber
*Attorney, Agent, or Firm*—Shlesinger, Fitzsimmons & Shlesinger

[57] ABSTRACT

A furnace to be heated to a high temperature which employs heating elements made from carbon or graphite. A longitudinal space within the furnace for accommodating said heating elements and a furnace bed for the transportation of articles to be treated through the furnace, is formed solely by blocks of porous carbon and without the employment of a conventionally prerequisite protective case. A pair of the heating elements extend along inner lateral walls of said space, facing to each other with the furnace bed therebetween, and have their electric terminals projecting through and outside of a bottom wall of the furnace.

2 Claims, 2 Drawing Sheets

HIGH TEMPERATURE HEATING FURNACE

BACKGROUND OF THE INVENTION

This invention relates to a resistance heating furnace, and more particularly, it relates to a high temperature heating furnace employing carbon materials as its resistance heating elements and furnace walls which enclose said resistance heating elements.

Conventional high temperature heating elements furnaces of the kind mentioned above are classified into two groups, viz., one shown in FIGS. 3 and 4 and called as a tubular direct heating high temperature furnace, and another shown in FIGS. 5 and 6 and called as a rod-type heating element high temperature heating furnace.

These high temperature heating furnaces have a metallic furnace frame 1 of a rectangular cross-section. There are provided at outer sides of the metallic furnace frame 1 water-cooled jackets 2. A protective case 11 made from carbon materials and having a circular or rectangular cross-section extends longitudinally along the axis of the furnace frame 1, and heating elements 5 are accommodated within the protective case 11.

Heat insulating materials 4 are contained in a space between the frame 1 and the protective case 11.

Since high temperature heating furnaces of the kinds mentioned above are employed for a heat treatment held at a high temperature between about 2,000° and 3,000° C., both of the aforementioned heating elements 5 and heat insulating materials 4 are made from carbon materials, that is, carbonaceous or graphite refractories.

Compared to the rod-type heating element high temperature heating furnace shown in FIGS. 5 and 6, electric supply structures for heating the heating element 5 (such as connecting terminals 6, insulators 7, terminals 8 of the heating element 5, and electric supply wires 10) in the above-mentioned tubular direct heating high temperature furnace become advantageously simple since the heating element 5 which is tubular and lies coaxially with the protective case 11, acts also as an inner furnace case, to both free ends of which common electric terminals are connected. However, on the other hand, it is disadvantegeous that a temperature distribution is not even along a longitudinal direction of the furnace. That is, since a temperature is highest at the middle portion of the furnace, and becomes lower towards the both ends of the furnace, a zone or area of an even temperature within the circular heating element which forms a furnace bed, is comparatively short. It is disadvantageous also in this kind of tubular direct heating high temperature furnaces that a heating loss of the heating element by a thermal conduction is large as the heating element constitutes, together with the protective case 11, furnace inlet and outlet openings directly exposed to an outer atmosphere.

The rod-type heating element high temperature heating furnace shown in FIGS. 5 and 6 belongs to a so-called indirect heating furnace, and has been developed so as to eliminate the aforementioned drawbacks or disadvantages accompanied to the tubular direct heating high temperature furnace which is illustrated in FIGS. 3 and 4 and belongs to a so-called direct heating furnace. In said rod-type heating element high temperature heating furnace, a longitudinal direction of the protective case 11 which is rectangular at its cross-section and accommodates therein a carbonaceous furnace bed 9, is supposedly divided to a plurality of sections, and to each of said sections at upper and lower positions thereof, there are provided carbonaceous heating rods 5 which extend transversely to the longitudinal direction of the protective case, whereby a zone or area of an even and common temperature can be enlarged and whereby a temperature distribution along the longitudinal direction of the furnace can be adjusted as desired. However, there are such drawbacks that heat dissipation is large since many through holes have to be formed in the protective case 11, carbonaceous heat insulating materials 4, and metallic furnace frame 1 in order to supply electric currents independently to each of the heating rods 5. In FIGS. 5 and 6, those members or parts which are identical to those of FIGS. 3 and 4, are represented by same numerals.

While as described above, conventional high temperature heating furnaces have their respective drawbacks, characteristic features common to them are that they employ unanimously the protective case 11 which extends along a longitudinal direction of the furnace frame and is made from carbon materials. The primary object of such employment of the protective case 11 either of a tubular or rectangular shape is to insulate from the heating element 5 the carbonaceous thermal insulating material 4 which are made of carbon or graphite granules or powders, carbon fibers (including those molded to a felt, or in bulk or blocks), or porous carbon materials.

The secondary object is to have the thermal insulating materials 4 keep a desired configuration so that they can accomodate a space in which a furnace bed is provided, when they are made of carbon or graphite granules or powders.

DISCLOSURE OF THE INVENTION

The primary feature of this invention is to provide a furnace heated to a high temperature by carbon heating element, in which a protective case for electrical insulation which has been prerequisite in conventional high temperature heating furnaces, is eliminated. In order to achieve this end, in the high temperature heating furnace made in accordance with this invention, a space within the heating furnace to which articles to be treated are forwarded, is built up soley with porous carbon materials, and said porous carbon materials are selected to be those having a electric resistivity larger than 6 Ω.cm.

The secondary feature of this invention is that a pair of carbon or graphite heating elements each of an elongated sheet form are provided within the furnace having a furnace bed in a longitudinally extending space formed by porous carbon materials per se so that the pair of heating elements extend longitudinally to the furnace along lateral walls of the space and face to each other with the furnace bed therebetween. Electric terminals are connected at both ends of each of the heating elements so that they extend at a right angle with the heating elements and downwardly, whereby electric supplies to the heating elements are made at a bottom side of the furnace, and a number of through holes for the supply of electric currents to the heating elements is considerably reduced compared to the number of through holes seen in FIGS. 5 and 6, resulting in that a rate of heat dissipation is lowered and a range of areas kept under an even temperature is widened. And, differently from the one seen in FIGS. 3 and 4, the heating elements have no end directly exposed to the outside of the furnace, whereby thermal dissipation via the heating elements is negligible in this invention furnace.

Thus, by this invention, structures of a high temperature heating furnace are simplified, and heat dissipation and consequently consumption of electricity are remarkably reduced on account of the simplified and unique structures thereof.

BRIEF DESCRIPTION OF THE DRAWING

In the accompanying drawings which illustrate a preferred embodiment of the high temperature heating furnaces made in accordance with this invention and conventional ones.

DETAILED DESCRIPTION OF THE INVENTION

This invention is explained below more in detail with reference to a preferred embodiment thereof.

Figure 1:
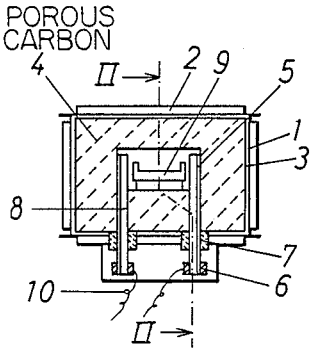
FIGS. 1 and 2 are cross-sectional views of the furnace made in accordance with this invention.
Figure 2:
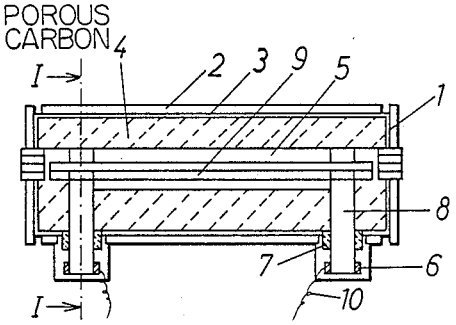
Figure 3:
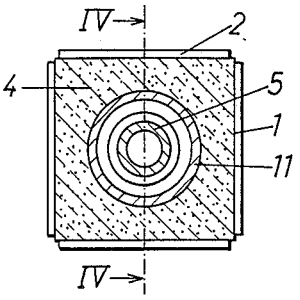
Fig. 3 Prior Art
FIGS. 3 and 4 are sectional views of a conventional high temperature direct heating furnace with a circular heating element.
Figure 4:
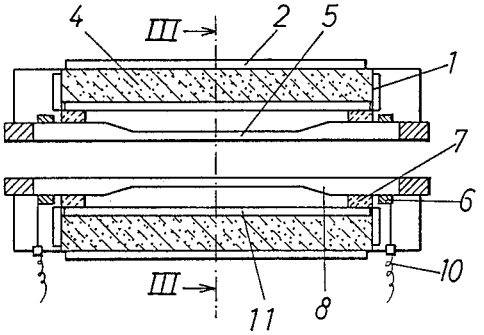
Fig. 4 Prior Art

In FIGS. 1 and 2, those parts and members which are identical with those in FIGS. 3 to 6, are represented and indicated by same numerals.

To an inner central part of the metallic furnace frame 1 having at its outer sides water jackets 2, there is formed, by the employment of a block or blocks of porous carbon a thermal insulator or line 4, a space of a rectangular cross section which extends along the longitudinal direction of the furnace frame so as to accommodate therein the furnace bed 9 and which opens at the both longitudinal ends of the furnace frame so as to form inlet and outlet openings of the furnace through which articles to be treated are brought into and out of the furnace, traveling upon the furnace bed 9.

Said porous carbon is the one indicated by the material mark I-3 in the following table, bulk density of which is small, electric resistivity of which is larger than those indicated by the material marks I-1 and I-2 in the table, and applied voltage of which by the heater elements is also small whereby a shunt current therethrough is nominal even when it touches with the heating elements. By the way of precaution, the furnace frame is additionally insulated electrically at its inner sides where a temperature is comparatively low, by a thin layer of ceramic fibers and the like.

TABLE

| Material | Usege | Shape | Electric resistivity (Ω · cm) | Thermal Conductivity (Kcal/mh°C.) |
|---|---|---|---|---|
| H-1 | heating element | graphite plate, rod | 0.001–0.0007 | 50.0 |
| I-1 | thermal insulator | graphite powders | 0.03–0.09 | 0.7 |
| I-2 | thermal insulator | carbon felt | 0.15–0.4 | 0.65 |
| I-3 | thermal insulator | porous carbon block | 1–6 | 0.25 |

A pair of the heating elements 5 of an elongated plate shape are provided in the space so that they extend longitudinally to the longitudinal axis of the furnace and along the vertical lateral walls of the space. Though only a pair of the heating elements are illustrated in the drawing for making the drawing simple, they might be a plurality of pairs extending in parallel with each other in the space in accordance with a desired temperature distribution of the furnace. The electric supply terminals of the heating elements are provided to such bottom of the furnace which belongs to a part, temperature of which is lowest compared to other parts of the furnace.

Figure 5:
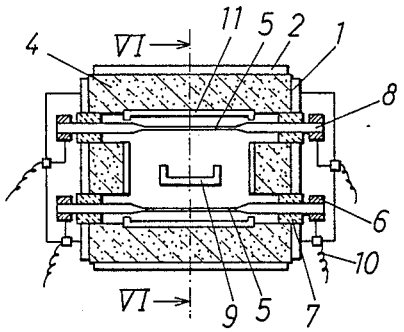
Fig. 5 Prior Art
FIGS. 5 and 6 are similary sectional views of a conventional high temperature indirect heating furnace with heating rods.
Figure 6:
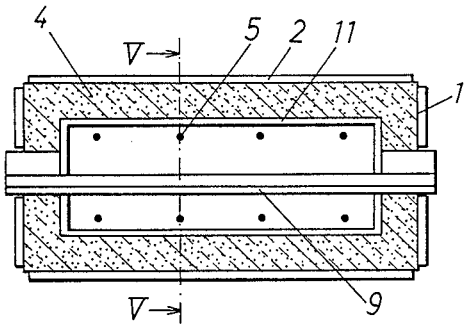
Fig. 6 Prior Art

The high temperature heating furnace of this invention explained above and the conventional furnace illustrated in FIGS. 5 and 6 and explained also above are compared about their thermal dissipation.

Figure 7A:
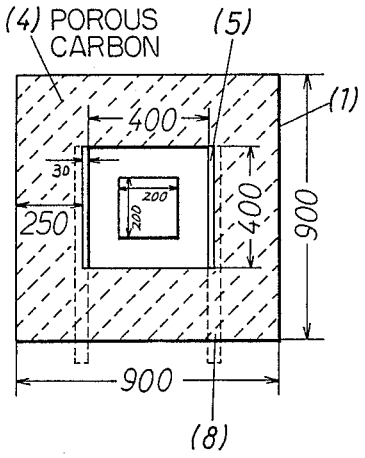
FIGS. 7(*a*) and 7(*b*) are sectional views for the dimensional comparison of the furnace of this invention and the conventional one shown in FIGS. 5 and 6.
Figure 7B:
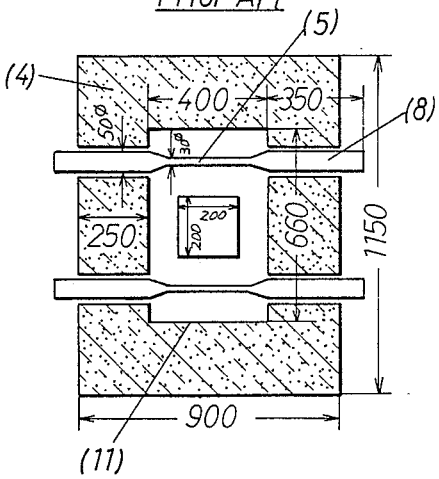
Fig. 7b Prior Art

Dimensional sizes (of mm) of the furnace of this invention would be as shown in FIG. 7(*a*), while those of the conventional furnace (of FIGS. 5 and 6) would be given in FIG. 7(*b*), provided that articles to be treated in said two furnaces were same as to their dimensions, viz., 200 mm in width×200 mm in height. The length of the furnaces was equally 1 m. Thermal insulator (4) of this invention furnace was made from the material mark I-3 of the aforementioned table, while that of the conventional furnace was made from the mark I-2 of said table. The thickness of both insulators was made same as shown in the drawing.

Thermal dissipation at 2,000° C. was 3,120 Kcal/h in this invention furnace, while 11,575 Kcal/h in the conventional furnace.

When a heating electricity of the heating elements in this invention was set to 10 KW, electric voltage and current thereof were respectively only 9.5 V and 1,043 A.

Nextly, electric currents to be flown to the thermal insulators (4) respectively in FIG. 7(*a*) and FIG. 7(*b*) by their contact with the heating element (5) are compared.

Electric resistance of the heating element (made from the material mark H-1 of the above-mentioned table supposed to have an electric resistivity of 0.001 Ω.cm, and of the dimension shown in FIG. 7(*b*)) is calculated as 0.01357Ω, while geometrical resistance of the insulator (4) which is in contact with said heating element (8) is as given in the following calculation granting that electric current flows to the insulator in thickness of 100 mm around the heating element of 50 mmϕ.

$$R = \frac{1}{2\pi} \ln \frac{r_2}{r_1} = \frac{1}{2\pi} \ln \frac{12.5}{2.5} = 0.256$$

Accordingly, resistance of the insulator (4) of FIG. 7(*a*) made from the material mark I-3 supposed to have an electric resistivity of 6 Ω.cm shall be:

$$Ra = \rho R \times \frac{1}{\frac{25}{2}} = 6 \times 0.256 \times \frac{2}{25} = 0.1229\Omega$$

And, resistance of the insulator (4) of FIG. 7(*b*) made from the material mark I-2 supposed to have an electric resistivity of 0.4 Ω.cm shall be:

$$Rb = 0.4 \times 0.256 \times \frac{2}{25} = 0.00819\Omega$$

It shall be known from the above that the ratio between the resistances of the insulator and the heating element in FIG. 7(*a*) of this invention is $0.1229\Omega/0.01357\Omega \approx 9.06$. Likewise, the ratio between the resistances of the insulator and the heating element in FIG. 7(*b*) of the conventional one is $0.00819\Omega/0.01357\Omega \approx 0.6$.

To wit, in case of FIG. 7(*a*) explained above, the furnace is practical, since electric resistance of the insulator (4) is sufficiently large against the heating element (8), that is, about 9.06 times of the latter, while in case of FIG. 7(*b*) with the above explained conditions, furnace thereof is not practical since resistance of the insulator is inferior to the heating element.

The above experiments teach also that the high temperature heating furnace made in accordance with this invention is practical if the thermal insulator (4) is afforded with an electric resistivity at least of or larger than 6 Ω.cm.

I claim:

1. A high temperature heating furnace having therein carbon or graphite heating elements operative to heat the interior of said furnace to a temperature range of approximately 2000° C. to 3000° C., and which comprises a frame, a liner having therethrough a space extending longitudinally throughout a longitudinal distance of the furnace for passing therethrough articles to be treated by the furnace, said liner being formed within said frame by thermal insulation blocks having internal surfaces facing upon and defining said space, and being made from porous carbon having an electric resistivity in the range of approximately to 1 to 6 Ω.cm, and at least a pair of said carbon or graphite heating elements having an electric resistivity in the range or approximately 0.001 to 0.0007 Ω.cm, and being mounted to extend longitudinally of the furnace and along opposite sides, respectively, of said space.

2. The furnace as claimed in claim 1, in which the heating elements are positioned in confronting relation to the porous carbon defining said oppposite sides of said space, and said elements are provided with electric terminals projecting through the bottom of the furnace.

* * * * *